United States Patent [19]

Hering, Jr. et al.

[11] 4,125,948

[45] Nov. 21, 1978

[54] DRYER FOR PRINTED WEBS

[75] Inventors: Henry H. Hering, Jr., Homewood; Gerald J. Bender, Park Forest, both of Ill.

[73] Assignee: R. R. Donnelley & Sons Company, Chicago, Ill.

[21] Appl. No.: 760,121

[22] Filed: Jan. 17, 1977

[51] Int. Cl.[2] ..... F26B 13/04

[52] U.S. Cl. ..... 34/160; 34/155

[58] Field of Search ..... 34/156, 160, 155, 224, 34/225, 23, 232, 233

[56] References Cited

U.S. PATENT DOCUMENTS

| | | | |
|---|---|---|---|
| 1,980,558 | 11/1934 | Tandel | 34/160 |
| 1,994,220 | 3/1935 | Hormel | 34/225 X |
| 2,225,505 | 12/1940 | Offen | 34/23 |
| 2,226,319 | 12/1940 | Offen | 34/224 X |
| 2,264,329 | 12/1941 | Offen | 34/160 |
| 3,012,335 | 12/1961 | Allander et al. | 34/160 X |

FOREIGN PATENT DOCUMENTS

| | | | |
|---|---|---|---|
| 20,513 | 3/1956 | Fed. Rep. of Germany | 34/156 |
| 1,098,271 | 7/1955 | France | 34/160 |

*Primary Examiner*—William F. O'Dea
*Assistant Examiner*—Harold Joyce
*Attorney, Agent, or Firm*—Wegner, Stellman, McCord, Wiles & Wood

[57] ABSTRACT

A dryer for a freshly printed web from a gravure printing press achieves greatly improved performance as compared with prior art dryers by the use of the following novel structure and operating features:

(1) Air drawn into the dryer housing through the web inlet slot and heated air from nozzles in the upstream part of the housing, which air removes a great percentage of the solvent vaporized from the ink, goes directly to exhaust.

(2) Heated air from nozzles in the downstream part of the housing, and air drawn into the housing through the web outlet slot, goes to the blower and heater for recirculation through the nozzles. That air removes only residual solvent and thus has only a low concentration of vaporized solvent.

The foregoing features assure a very low solvent vapor concentration in the heated air.

(3) Make-up air goes directly to the blower and the heater from an adjustable air intake.

(4) The velocity of air impinging the web is maintained at or about 12,000 f.p.m.

(5) There is an air discharge opening just downstream from each nozzle to eliminate interference between air from the nozzles and air traversing the web to the discharge openings.

9 Claims, 3 Drawing Figures

2
26
22
33
33
16
10
45
42
17
14
47
43b
14
17
47
43b
11
12
47
43b
46
43a
14
14
46
43a
18
44
14
18
14
41
2

21
22
26
28
27
29
36
19
37
34
16
45a
30
10
42
38
23
32
31
14
23
47a
40b
40a
47a
43b
39
43b
23
24
47a
38a
14
25
23
40
46a
43b
43a
13
23
12
14
46a
43a
23
14
41
44a
23
20
14
48
W
15
S

DRYER FOR PRINTED WEBS

BACKGROUND OF THE INVENTION

Typically, commercial publication type gravure dryers have consisted of a recirculating air system in which a fan blows controlled temperature air through nozzle orifices against the wet ink on the paper web to produce a drying action. The spent air then returns to the same fan for repeated cycling. Concurrently an exhaust air system operates which taps off part of the return air going to the recirculation fan, using a second (exhaust) fan to eject it from the dryer system either to atmosphere or to some type of emission control system such as solvent vapor recovery. Makeup air to replace that exhausted leaks in from the room through the web entering and leaving slots.

It is known that a large percentage of the solvent vapors are liberated at or just ahead of the web entrance to the dryer so a separate duct is connected from the web entrance slot directly to the plenum from which exhaust and recirculated air are channeled to their respective fans. However, the fact that in all of the various models it has been customary to direct air to the recirculation fan inlet from this common plenum gives rise to a solvent vapor concentration problem. Although it is desirable to imping air on the web for drying purposes with as low a solvent vapor concentration as possible, there dryers actually use solvent air of excessively high concentration since it contains a great percentage of the air taken directly from the web inlet slot where the greatest solvent evaporation takes place. To compound the problem, it is found that the internal circuitry is so arranged that there is substantial shortcircuiting of low concentration air coming in through the web outlet slot directly to the exhaust duct.

Some prior art dryers present a safety problem. With both recirculated and exhaust air drawn from a common chamber, it is possible for the negative pressure from the recirculation fan to reach into the exhaust duct and produce a "safe" indication at the exhaust static pressure safety switch even though the exhaust fan, being monitored by this switch, is not running.

Some prior art patents which have systems of louvers for proportioning the recirculated air and the exhausted air have suggested that all spent air go to exhaust with drying being done only by new air brought into the system. This, however, is very wasteful of fuel because none of the air which has been heated before it impinges upon the web is recirculated, causing a dryer operated in that manner to have excessively high energy requirements for heating the air before it impinges the web.

The most pertinent patents of which applicant is aware are U.S. Pats. No. 2,225,505, issued Dec. 17, 1940 to Bernard Offen, and U.S. Pat. No. 2,226,319, issued Dec. 24, 1940 to Bernard Offen.

SUMMARY OF THE INVENTION

In accordance with the present invention, a dryer is provided with a housing through which a freshly printed web is guided from an upstream web inlet slot to a downstream web outlet slot. A series of air discharge nozzles are spaced along the interior of the housing to discharge heated air directly upon the freshly printed web surface; and in addition, of course, air at ambient temperature enters the housing both through the web inlet slot and through the web outlet slot.

In the housing are an air recirculating system and an air exhaust system which are completely segregated from one another. Air entering the housing through the web inlet slot and spent air from the nozzles nearest the web inlet slot goes directly to exhaust. Air entering the system through the web outlet slot and spent air from the nozzles nearer to the outlet slot enters the recirculating duct system and is recirculated to the nozzles by a blower from which it passes over air heating means in an air delivery duct. In addition, there is an adjustable makeup air inlet from which air enters the blower along with the recirculating air.

The above described structure presents a number of advantages over the prior art dryers known to applicant.

1. A very high percentage of the total solvent in the wet ink is vaporized by the air entering the housing through the web inlet slot and by the air which impinges the freshly printed web surface in the upstream portion of the housing. Thus, that air has a very high solvent vapor concentration, and to recirculate any part of it through the dryer nozzles results in relatively low efficiency because the rate of evaporation of solvent from the ink depends upon the solvent vapor concentration in the heated air which impinges the web.

2. The most difficult part of the drying job is removing residual solvent, particularly from those areas of a web having heavy ink coverage as in the darkest areas of a four-color reproduction.

A drying curve has a constant rate portion and a falling rate portion, and generally speaking the removal of residual solvent occurs during the falling rate portion of the drying curve. Accordingly, it is highly desirable that air impinging the web during the falling rate portion of the curve have a low solvent vapor concentration in order to have the maximum capacity to remove solvent from the ink. Air entering the housing through the web discharge slot picks up no solvent vapor as it enters the housing, and in the present system such air goes directly into the recirculating blower. Spent air from the nozzles in the downstream part of the housing carries a very low solvent vapor concentration because the entire constant rate portion of the drying curve is while the web is in approximately the first half of the housing.

Another feature of the present dryer is that there is an air discharge opening immediately downstream from each nozzle, so that there is no interference between air flowing along the web surface to an outlet and air emitted from a nozzle for impingement upon the web. This, too, substantially increases drying efficiency as against any dryer in which air from one nozzle must pass across another nozzle in order to reach an air discharge opening.

Finally, it has been recognized for some time that an important factor in dryer efficiency is the velocity of air impinging the web. Heretofore it has been believed that with the relatively low viscosity inks used in gravure printing high impingement air velocities would slur or blur the ink by the high impact velocity of the air streams from the nozzles. As a result, prior art dryers for gravure printing have limited the air velocity to about 8,000 fpm.

In the course of developing the present dryer, applicant learned that the air entering the dryer through the web inlet slot removes such a high percentage of the solvents that by the time the web reaches the first air discharge nozzle there is insufficient surface solvent in the ink to permit slurring or blurring even under impingement velocities far higher than those previously considered tolerable.

Thus, a dryer constructed in accordance with the present invention is provided with a blower, an air delivery duct and nozzles which deliver air at velocities in excess of 10,000 fpm, and preferably in excess of 12,000 fpm. Such velocities have been known in forms of web printing using more viscous inks than are employed in gravure printing; but the high impingement air velocities have always been carefully avoided in gravure dryers.

An advantage to the present dryer is that, because recirculated air and exhaust air are not drawn from a common chamber, there is no possibility for a false "safe" indication at the exhaust fan static pressure safety switch caused by a negative pressure from the recirculation blower when the exhaust fan is actually not running. Such false indications of safe operating conditions are extremely dangerous because they can result in vapor concentrations within the housing which are high enough to be explosive.

Additional problems which are present in many prior dryers include blowout of solvent vapors from the web outlet slot due to an imbalance between recirculated air and makeup air from sources other than the web inlet and outlet slots, and good control of web handling to avoid fluttering or rubbing of the web against dryer surfaces.

The present dryer allows much simpler control over the foregoing two problems than has been possible with prior art dryers. The low solvent vapor concentrations of the spent impingement air entering the recirculation duct means that very little makeup air is required to maintain a solvent vapor concentration which is low enough for efficient drying and to meet safety requirements. Accordingly, the volume of makeup air can easily be kept low enough that there is no question of it exceeding the air volume entering through the web outlet slot and causing blowout of solvent vapor from the housing. At the same time, the control over the makeup air inlet can be balanced with the volume of air drawn through the web outlet slot and the recirculated volume of spent air so as to assure good web handling characteristics.

THE DRAWINGS

FIG. 1 is a front elevational view of the apparatus of the invention with the front housing panel and parts of the web guide rollers broken away to show the partition in which the air nozzles and the air discharge openings are formed;

FIG. 2 is a vertical sectional view taken substantially as indicated along the line 2—2 of FIG. 1 with a portion of a paper web in the position that it occupies in the housing during drying, an arrowhead at the top of the web shows the direction of web travel, while arrows show the directions of air flow in various parts of the apparatus; and FIG. 3 is a sectional perspective view taken substantially along the line 2—2 of FIG. 1 with the front housing wall and guide rollers omitted and with arrows showing paths of air flow.

DETAILED DESCRIPTION OF THE INVENTION

Figure 1:
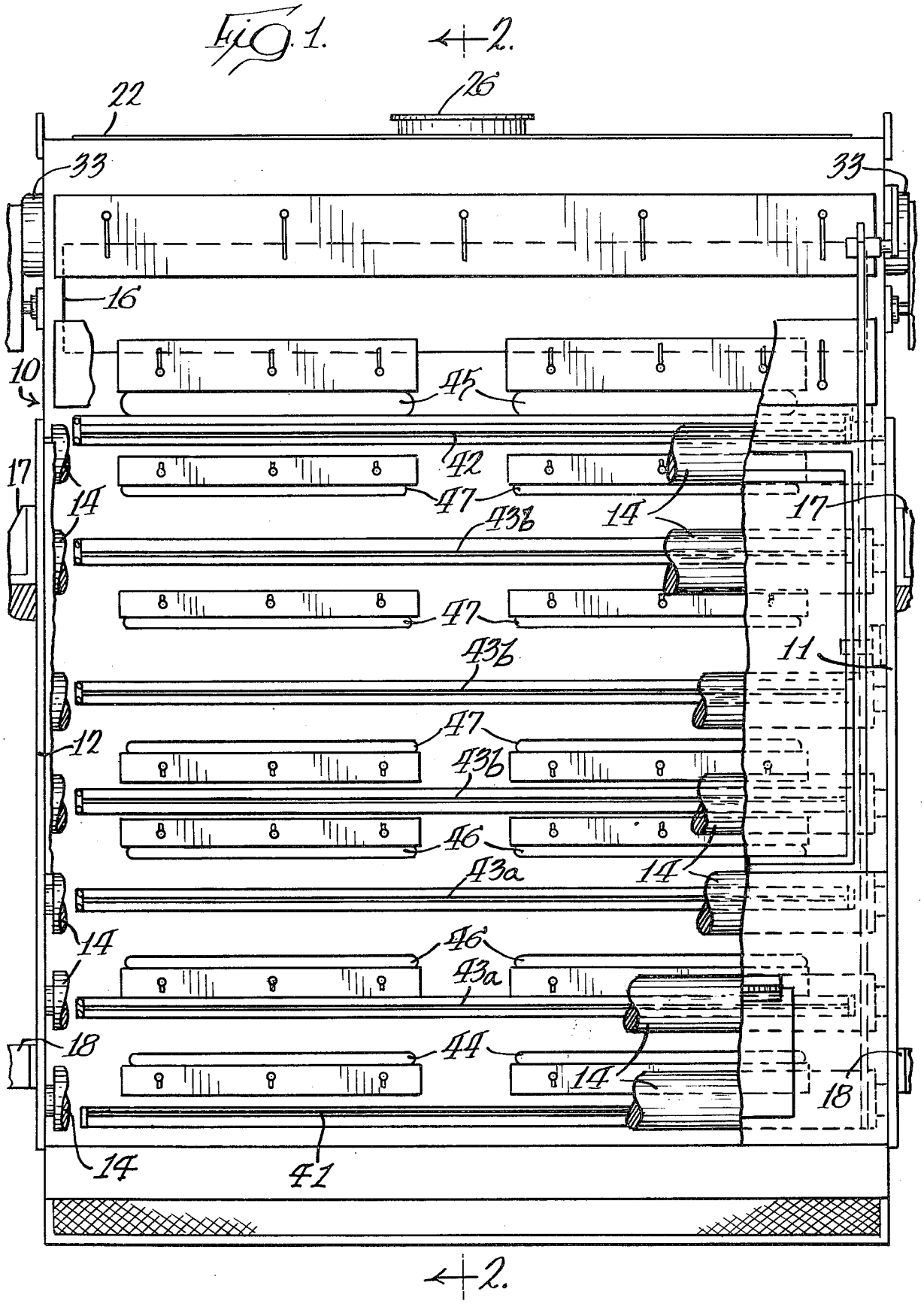
Figure 2:
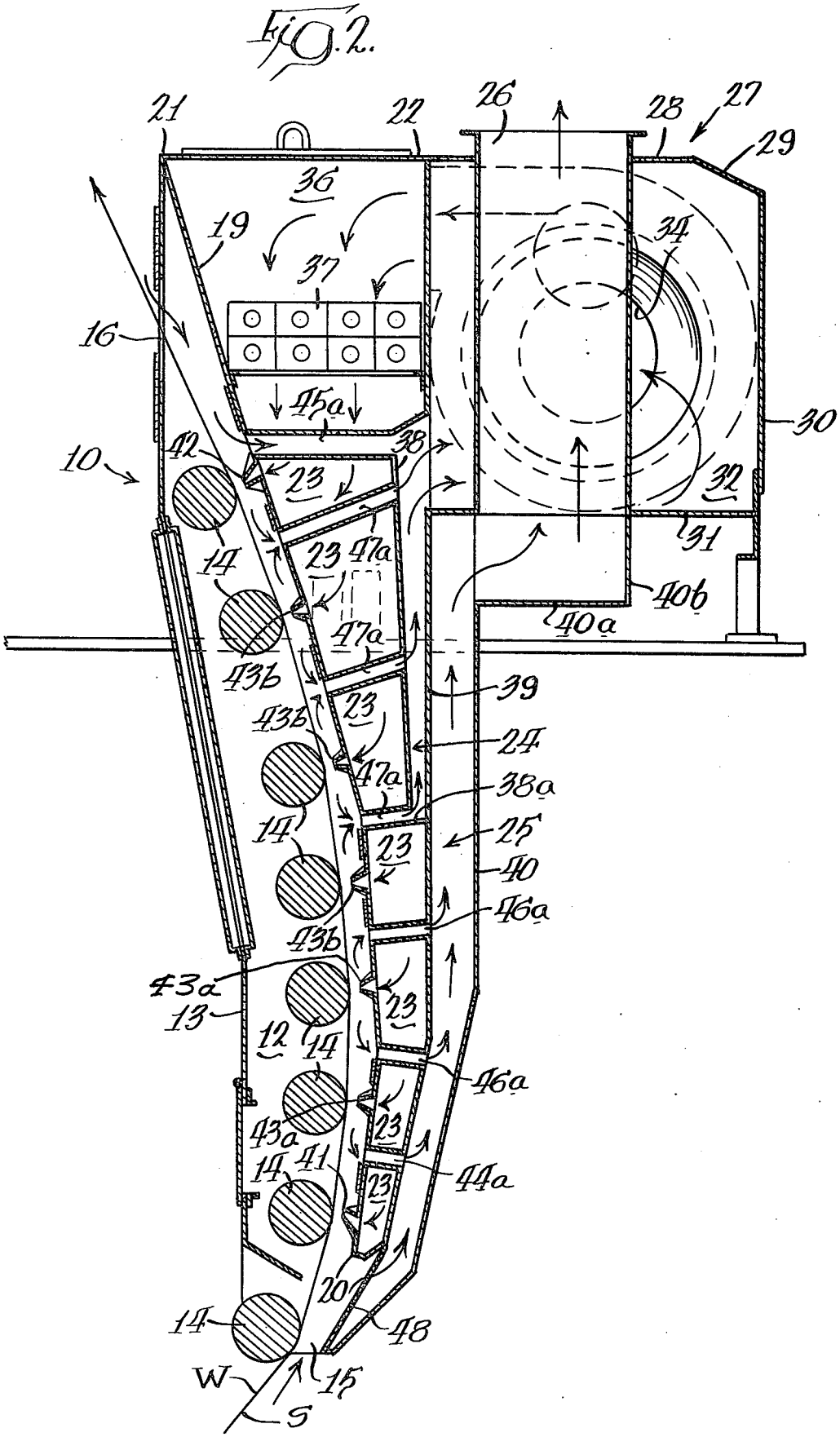

Referring to the drawings in greater detail, and referring first to FIGS. 1 and 2, the apparatus of the present invention includes a housing, indicated generally at 10, which includes end walls 11 and 12 and a front wall 13. The end walls 11 and 12, adjacent the front wall 13, are provided with openings in which journals for a series of rollers 14 are closely fitted. The rollers 14 serve as guide means upon which a freshly printed web W passes through the housing 10 from a web inlet slot 15 which is at the bottom of the housing through a web outlet slot 16 which is formed in the front wall 13 near the top of the housing. As indicated by the arrowhead at the upper end of the web W, the web passes upwardly through the housing, so that the inlet slot is at an upstream end and the outlet slot at a downstream end of the housing remote from the upstream end. The housing is mounted upon structural members 17 and 18 above a rotogravure web printing press from which the web W is received.

Figure 3:
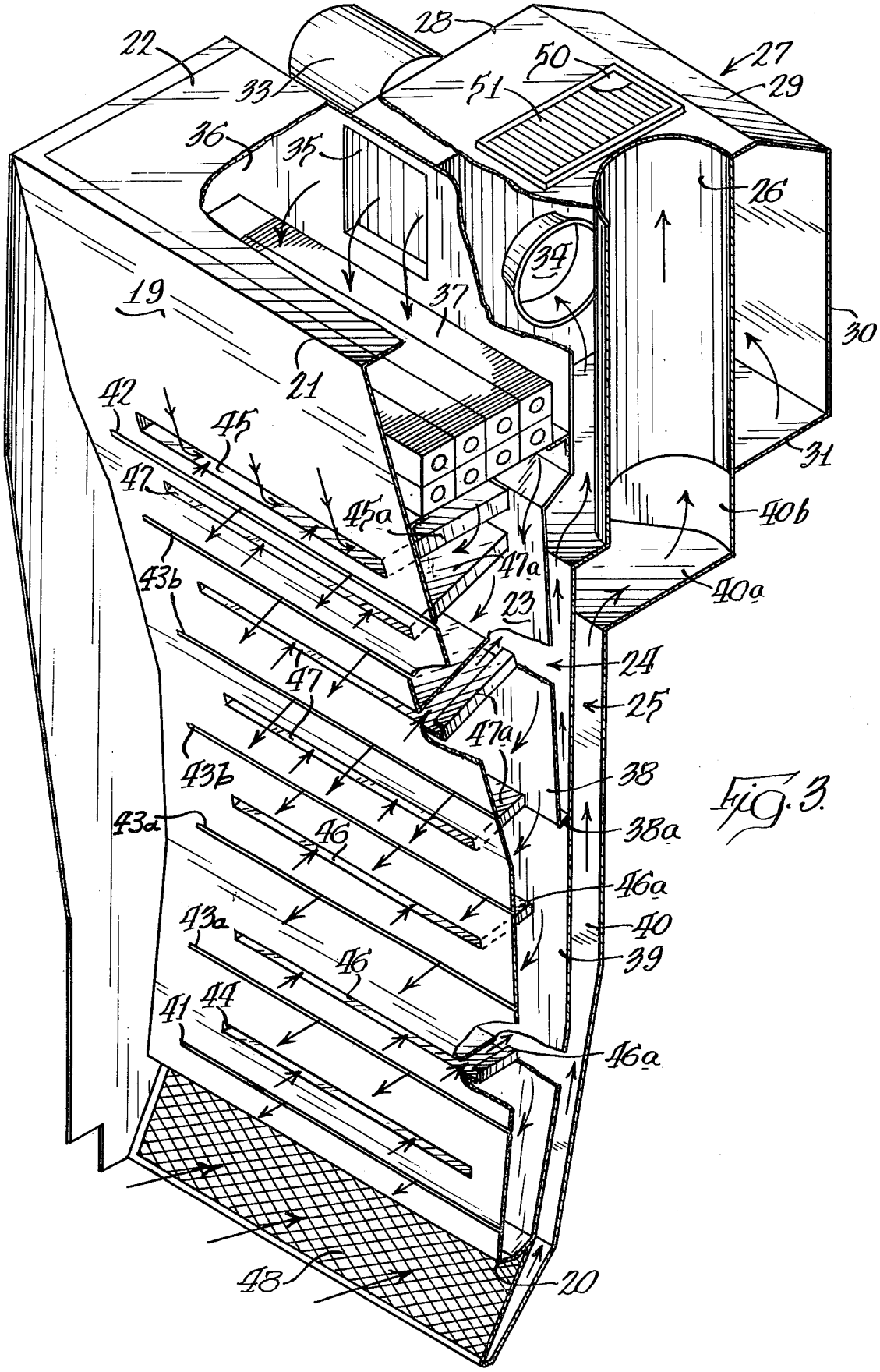

Toward the rear of the housing, in close proximity to the web W, is a partition 19 which has a lower end 20 close to the web inlet slot 15 and an upper end 21 secured to the upper end of the housing front wall 13 and to a top wall 22 which forms the upper end of an air delivery duct means, indicated generally at 23, and air recirculating duct means, indicated generally at 24, both of which are behind the partition 19. Exhaust duct means, indicated generally at 25, is positioned at the rear of the housing 10 and the exhaust duct means takes exhausted air out of the housing through a conduit 26 which is best seen in FIGS. 1 and 3 to be bisected by the vertical median plane of the housing. The conduit 26 is conventionally connected to a duct system which includes an exhaust fan handling several dryers, and discharging to a solvent recovery system which prevents release to the atmosphere of solvent vapor fumes in excess of limits set by current statutes and regulations.

Behind the upper portion of the housing 10 is a fan housing, indicated generally at 27 which includes a top plate 28 coplanar with the housing top wall 22, an inclined rear upper plate 29, a back plate 30, and a bottom plate 31, as well as end plates such as the end plate seen in FIG. 2.

At the ends of the blower housing 27 are blowers 33 which are in a circuit with the air delivery duct means 23 and the recirculating duct means 24 as will be described in more detail. The blowers have scrolls with inlets 34 and outlets 35 (FIG. 3).

The blowers 33 deliver air through the scroll outlets 35 to a plenum 36 which is supplied with heating means such as steam coils 37. After passing over the heat exchange surfaces of the steam coils 37, air from the blower 33 enters the air delivery duct means 23 which is between the partition 19 and a rearward partition 38. At the bottom of the rearward partition 38 is a flange **38*a* that connects the lower end of the rearward partition 38 to a wall 39 which defines the front of the exhaust duct means 25. A rear wall 40 and walls 40*a* and 40*b* define the rear of the exhaust duct means 25**.

The air delivery duct means 23 communicates with a series of air nozzles which are set into the front of the partition 19 so as to direct heated air from the air delivery duct 23 to the freshly printed surface S of the web W; the nozzles including a lowermost nozzle 41 which is seen in FIG. 2 to be inclined somewhat upwardly; an uppermost nozzle 42 which is seen to be inclined somewhat downwardly, and intermediate nozzles **43*a* and 43*b* which deliver air substantially normal to the web W. The nozzles 43*a*** constitute a first group in the first half of the housing and thus deliver air during the constant rate portion of the drying curve, while the nozzles 43*b* constitute a second group in the second half of the housing and deliver air during the falling rate portion of the drying curve. In FIG. 2 the distance between the nozzles 41, 42 and 43 and the web W is somewhat exaggerated, because the actual distance in practice is so small that it would not be visible at the scale of the drawings. The actual distance from the nozzle to the web is only about ⅜ which, with a nozzle slot width of 0.112 gives a nozzle-web distance which is about 3.34 times nozzle slot width. This is a significant factor in achieving high performance drying.

The capacity of the blowers 33 and the construction of the plenum 36, the steam coil 37, the air delivery duct means 23 and the nozzles 41, 42 and 43 are such as to give a nozzle exit velocity in excess of 10,000 feet per second, and preferably about 12,000 feet per second. This, also, is an important factor in achieving a high dryer efficiency.

The partition 19 is also provided with air discharge openings which include a first opening 44 near the web inlet slot 15, a second opening 45 near the web outlet slot 16, an upstream group of discharge openings 46 which are between the first opening 44 and the plane of the flange 38*a* which segregates the air delivery duct 23 from the recirculating duct 24, and a downstream group of air discharge openings 47 which are above the plane of the flange 38*a* and below the second discharge opening 45. Each of the discharge openings 44, 45, 46 and 47 communicates with a shallow conduit, and such conduits are identified as 44*a* through 47*a*, as seen in FIGS. 2 and 3.

The web inlet slot 15 communicates directly with the exhaust duct means 25 through a screen 48, and the first air discharge opening 44 and conduit 44*a*, receiving spent air from the nozzle 41, together with the upstream openings 46 and conduits 46*a* receiving spent air from the nozzles 43*a*, also communicate directly with the exhaust duct means 25. The second air discharge opening 45 and associated conduit 45*a*, receiving air from the web outlet slot 16 together with the downstream openings 47 and conduits 47*a* receiving spent air from the nozzles 43*b*, open into the recirculating duct 24.

As best seen in FIG. 3, the recirculating duct 24 communicates with the scroll inlets 34 of the blowers 33 through the housing 27; and make-up air inlets 50 which also communicate with the scrolls through the housing are provided with adjustable louvers 51. The louvers 51 are so adjusted as to effect a balance between air entering through the inlets 50 and air entering through the web outlet slot 16 to achieve the good control of web handling, avoidance of fluttering or rubbing of the web against dryer surfaces, heretofore referred to.

Evaluation tests comparing a prototype of the dryer here disclosed with a modern, high quality commerically available prior art dryer were made. Dryer performance was measured by a "blocking test" which consists of clamping a complete set of signatures from one impression under the ram of a pneumatic cylinder for 30 minutes at 60 p.s.i. pressure. At the end of 30 minutes all the pages are examined for evidence of offsetting, "picking" (adherence of ink from one sheet to another), or resistance to separation of the sheets from one another. If any of the foregoing undesirable phenomena were present, the tested sample was deemed to have "blocked", and thus to be unsatisfactory.

There were three groups of tests as follows:

1. Supply air temperature was reduced in 25F. increments starting at maximum achievable value until "blocking" appeared.

2. Web speed was taken to the maximum achievable by the press to determine the effectiveness of the dryers at that speed.

3. Xylol content of the ink was increased in 5% increments until "blocking" was produced.

The conclusions derived from the test follow.

1. Temperature tests

The prototype dryer showed no evidence of blocking at a web speed of 1925 f.p.m. and an air temperature as low as 109° F., a temperature which can be achieved with the steam coil 37 cut off so that the only heat is from friction in the system. At 2,025 f.p.m. blocking occurred at 109° F. but not at 200° F. At the speed of 2,025 f.p.m. the commercial dryer showed evidence of "blocking" at 220° F. air temperature.

2. Speed tests

The two dryers were tested at different press speeds and different temperatures. As previously indicated, with a press speed of 1925f.p.m. the prototype dryer did not block at 109° F.; but at the same temperature it did block with press speeds of 2,025 f.p.m. or higher.

At a supply air temperature of 200° F. the prototype dryer did not block at any press speed to and including 2,075 f.p.m.

The commercial dryer with air at 212° F. blocked both at 2,025 and 2,075 f.p.m. It was not tested at lower speeds at that temperature.

3. Xylol tests

Xylol is one of the heavier components of an ink mixture, and has a relatively high boiling point; so it tends to stay in the paper as residual solvent to a greater extent than do other fractions of the ink.

Since the prototype dryer had not exhibited blocking at a press speed of 2,075 f.p.m. and a supply air temperature of 200° F., it was decided to run the Xylol tests at 2,075 f.p.m. (maximum available press speed) and at that supply air temperature. The prototype dryer showed no blocking with extra Xylol increments of 5% and 10%. At 15% it did show blocking.

The commercial dryer at a supply air temperature of 213° F. and a press speed of 2,075 f.p.m. showed equivocal results which were construed as nonblocking with 5% additional Xylol; but at 10% there was clear evidence of blocking.

The ability of a dryer to function satisfactorily at high press speeds and relatively low temperatures is economically very significant. The desirability of operating at maximum press speeds is well known. Drying at lower temperatures produces two benefits. The first is that less heat is required, so that energy requirements are reduced. The second is that there is less web shrinkage and distortion at lower temperatures, and this reduces register problems.

The foregoing detailed description is given for clearness of understanding only and no unnecessary limitations should be understood therefrom as modifications will be obvious to those skilled in the art.

I claim:

1. In a dryer for a freshly printed web which includes a housing having a web inlet slot at an upstream end and a web outlet slot at a downstream end remote from said upstream end, air being free to enter the housing through both said slots, web guide means in the housing upon which a freshly printed web issuing from a high speed rotary printing press traverses the housing from said inlet slot through said outlet slot and an air circulating system including a partition in the housing which has a front surface in close proximity to the freshly printed web surface, a series of air nozzles in and along said partition directed toward said web surface, and air discharge openings in said partition including a first opening near the web inlet slot and a second opening near the web outlet slot, the improvement comprising, in combination:

air delivery duct means behind said partition provided with a blower to deliver air through all the air nozzles in said series:

means for heating air delivered by said delivery duct means;

recirculating duct means behind said partition for recirculating air within the housing to said air delivery duct means, said recirculating duct means communicating directly with only said second air discharge opening and said web outlet slot;

exhaust duct means behind said partition for exhausting air from the housing, said exhaust duct means communicating directly with only the web inlet slot and the first air discharge opening segregating partition means which (a). completely segregates the recirculating duct means from the exhaust duct means, (b). segregates the recirculating duct means from direct communication with the web inlet slot and with the first air discharge opening, and (c). segregates the exhaust duct means from direct communication with the web outlet slot and the second air discharge opening;

and an adjustable make-up air inlet from which make-up air enters the blower.

2. The combination of claim 1 in which there is an air discharge opening immediately downstream from each of the series of air nozzles, whereby there is no interference between air emitted from the nozzles and air passing along the front surface of the partition to a discharge opening.

3. The combination of claim 2 in which there are several nozzles and air discharge openings, the recirculating duct means communicates directly with only the air discharge openings which are in approximately the downstream half of the partition, and the exhaust duct means communicates directly with only the air discharge openings in approximately the upstream half of said partition.

4. In a dryer for a freshly printed web which includes a housing having a web inlet slot at an upstream end and a web outlet slot at a downstream end remote from said upstream end, air being free to enter the housing through both said slots, web guide means in the housing upon which a freshly printed web issuing from a high speed rotary printing press traverses the housing from said inlet slot through said outlet slot, and an air circulating system which includes a series of air nozzles in and along the housing directed toward said web surface, the improvement comprising, in combination:

air delivery duct means including a blower to deliver heated air through all the air nozzles in said series;

recirculating duct means which receives air entering the housing through the web outlet slot and spent air from a nozzle of said series which is near said outlet slot and returns it to said blower;

exhaust duct means which receives air entering the housing through the web inlet slot and spent air from a nozzle of said series which is near said inlet slot and exhausts it from the housing;

partition means completely segregating said exhaust duct means from said recirculating duct means; and an adjustable make-up air inlet from which make-up air enters the blower.

5. The combination of claim 4 in which the recirculating duct means receives spent air from a plurality of nozzles which are in the downstream portion of the housing, and the exhaust duct means receives spent air from a plurality of nozzles which are in the upstream portion of the housing.

6. The combination of claim 5 in which each of said recirculating duct means and said exhaust duct means receives spent air from the nozzles in approximately one-half of the housing.

7. The combination of claim 4 in which there is a spent air discharge opening immediately downstream from each of the series of air nozzles, whereby there is no interference between air emitted from the nozzles and air passing along the web surface to a discharge opening.

8. In a dryer for a web having a surface freshly printed with rotogravure printing ink, said dryer including a housing having a web inlet slot at an upstream end and a web outlet slot at a downstream end, remote from said upstream end, air being free to enter the housing through both said slots, web guide means in the housing upon which a freshly printed web issuing from a high speed rotogravure printing press traverses the housing from said inlet slot through said outlet slot, and an air circulating system which includes a series of air nozzles in and along the housing directed toward said web surface, the improvement comprising, in combination:

air delivery duct means including a blower to deliver heated air through all the air nozzles in said series at a minimum velocity of about 10,000 f.p.m.;

recirculating duct means which receives air entering the housing through the web outlet slot and spent air from a nozzle of said series which is near said outlet slot and returns it to said blower;

exhaust duct means which receives air entering the housing through the web inlet slot and spent air from a nozzle of said series which is near said inlet slot and exhausts it from the housing;

partition means completely segregating said exhaust duct means from said recirculating duct means;

and an adjustable make-up air inlet from which make-up air enters the blower.

9. In a dryer for a freshly printed web which includes a housing having a web inlet slot at an upstream end and a web outlet slot at a downstream end remote from said upstream end, air being free to enter the housing through both said slots, web guide means in the housing upon which a freshly printed web issuing from a high speed rotary printing press traverses the housing from said inlet slot through said outlet slot, and an air circulating system which includes a series of air nozzles in and along the housing directed toward said web surface, the improvement comprising, in combination:

a first group of said series of nozzles nearer the web inlet slot is in an area in which solvent is removed from the web at a generally constant rate;

a second group of said nozzles nearer the web outlet slot is in an area in which solvent is removed from the web at a decreasing rate;

air delivery duct means including a blower for discharging heated air through all the air nozzles in said series;

exhaust duct means which receives air entering the housing through the web inlet slot and spent air from all the nozzles of said first group and exhausts it from the housing;

recirculating duct means which receives air entering the housing through the web outlet slot and spent air from all the nozzles of said second group and returns it to said blower;

partition means completely segregating said exhaust duct means from said recirculating duct means;

and an adjustable make-up air inlet from which air enters the blower.

* * * * *